US011691167B2

(12) United States Patent
Santagiuliana

(10) Patent No.: US 11,691,167 B2
(45) Date of Patent: Jul. 4, 2023

(54) SYSTEM FOR DISPENSING FLUIDS OR MIXTURES AND DEVICE USED IN SAID SYSTEM

(71) Applicant: TAPLAST s.r.l., Vicenza (IT)

(72) Inventor: Evans Santagiuliana, Vicenza (IT)

(73) Assignee: TAPLAST S.P.A.

( * ) Notice: Subject to any disclaimer, the term of this patent is extended or adjusted under 35 U.S.C. 154(b) by 0 days.

(21) Appl. No.: 17/676,271

(22) Filed: Feb. 21, 2022

(65) Prior Publication Data

US 2022/0176398 A1 Jun. 9, 2022

Related U.S. Application Data

(63) Continuation of application No. 16/755,676, filed as application No. PCT/IB2018/057682 on Oct. 3, 2018, now abandoned.

(30) Foreign Application Priority Data

Oct. 12, 2017 (IT) ..... 102017000115249

(51) Int. Cl.

| | |
|---|---|
| ***B05B 11/00*** | (2023.01) |
| ***B65D 83/00*** | (2006.01) |
| ***B05B 11/10*** | (2023.01) |

(52) U.S. Cl.

CPC ..... *B05B 11/1033* (2023.01); *B05B 11/1067* (2023.01); *B05B 11/1069* (2023.01); *B65D 83/0055* (2013.01)

(58) Field of Classification Search

CPC ..... B05B 11/3033; B05B 11/3067; B05B 11/3069; B05B 11/00412; B05B 1/3405; B05B 11/0032; B65D 83/0055

See application file for complete search history.

(56) References Cited

U.S. PATENT DOCUMENTS

| | | | | |
|---|---|---|---|---|
| 2,657,953 | A * | 11/1953 | Hopper | B05B 1/3405 239/491 |
| 4,842,165 | A * | 6/1989 | Van Coney | B65D 83/0055 222/105 |
| 6,460,781 | B1 | 10/2002 | Garcia et al. | |
| 2006/0186140 | A1 | 8/2006 | Kanfer et al. | |
| 2006/0255068 | A1 | 11/2006 | Genosar | |
| 2017/0238688 | A1* | 8/2017 | Wu | A46B 11/0065 |
| 2018/0133731 | A1* | 5/2018 | Ritsche | B05B 11/0032 |

OTHER PUBLICATIONS

Patent Cooperation Treaty (PCT), International Search Report and Written Opinion for Application PCT/IB2018/057682 filed on Oct. 3, 2018, dated Nov. 28, 2018, International Searching Authority, EP.

* cited by examiner

*Primary Examiner* — Donnell A Long
(74) *Attorney, Agent, or Firm* — McDonald Hopkins LLC

(57) ABSTRACT

The present invention concerns a system (1; 501; 601; 701; 801) for dispensing a fluid (L), comprising a container (C; C') for the fluid (L) and a device (10; 210; 210'; 310; 410; 410') for dispensing the fluid (L). The device (10; 210; 210'; 310; 410; 410') comprises a collapsible chamber (20) which defines a volume (V) suited to receive a quantity of said fluid (L) to be dispensed. The chamber (20) is defined by a first portion (30) and a second portion (130) mutually coupled with each other, wherein the first portion (30) comprises an area connected to the container (C; C') and wherein the second portion (130) comprises an area connected to the container (C; C').

6 Claims, 13 Drawing Sheets

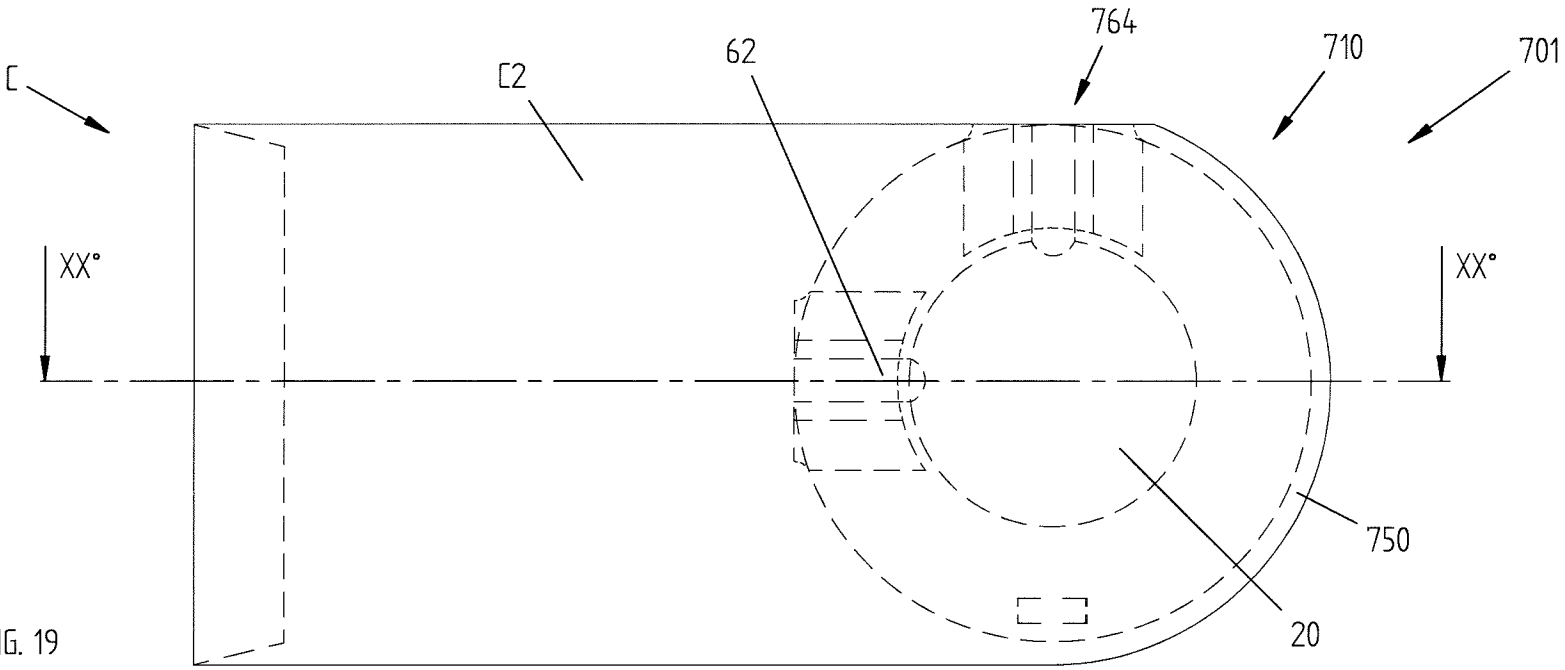
FIG. 19
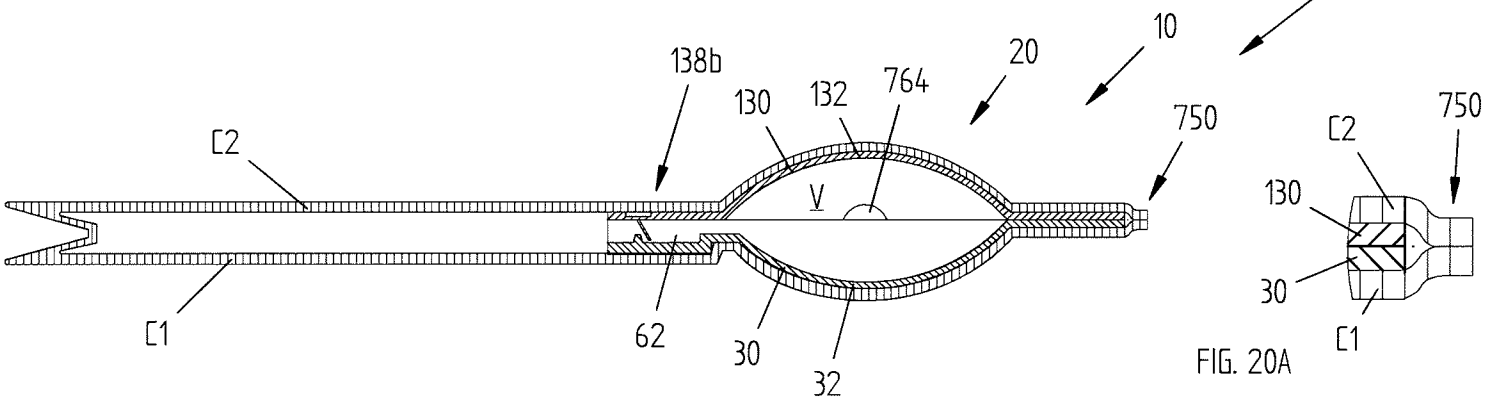
FIG. 20
FIG. 20A

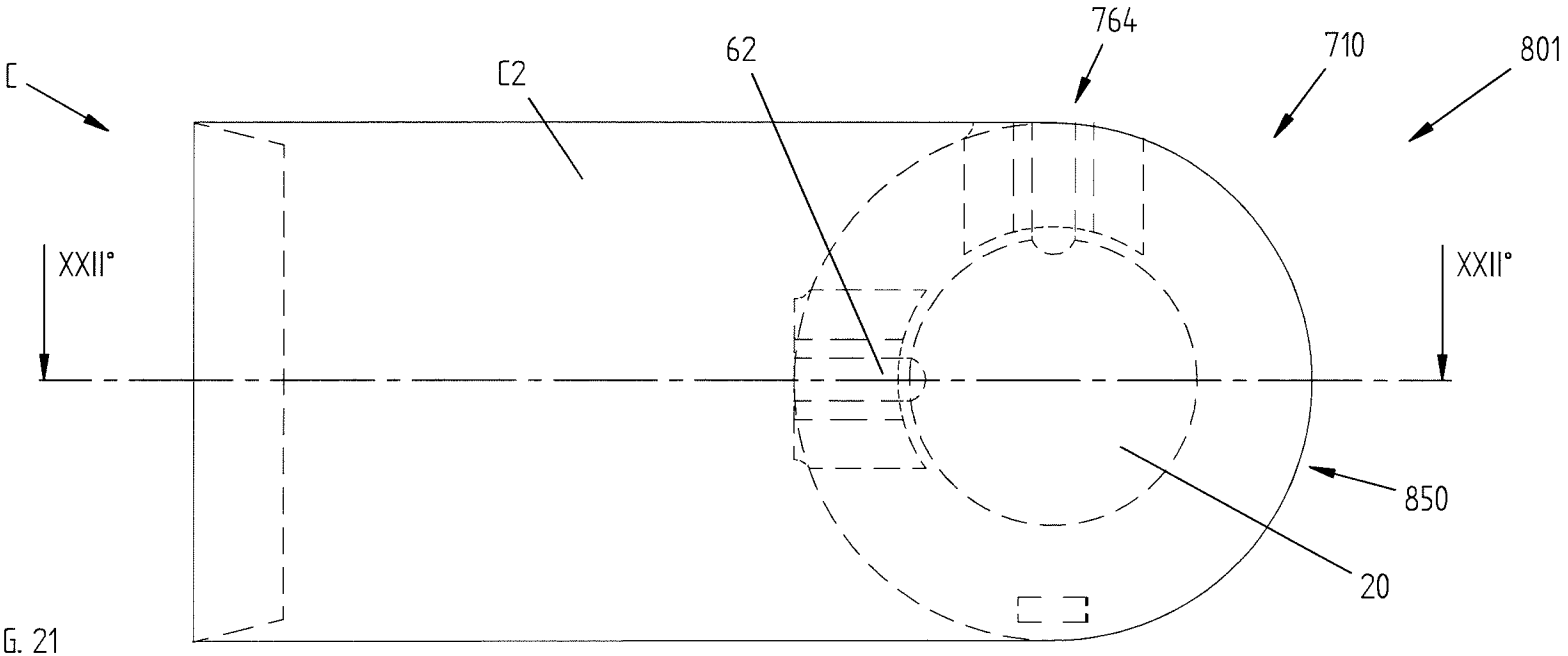
FIG. 21
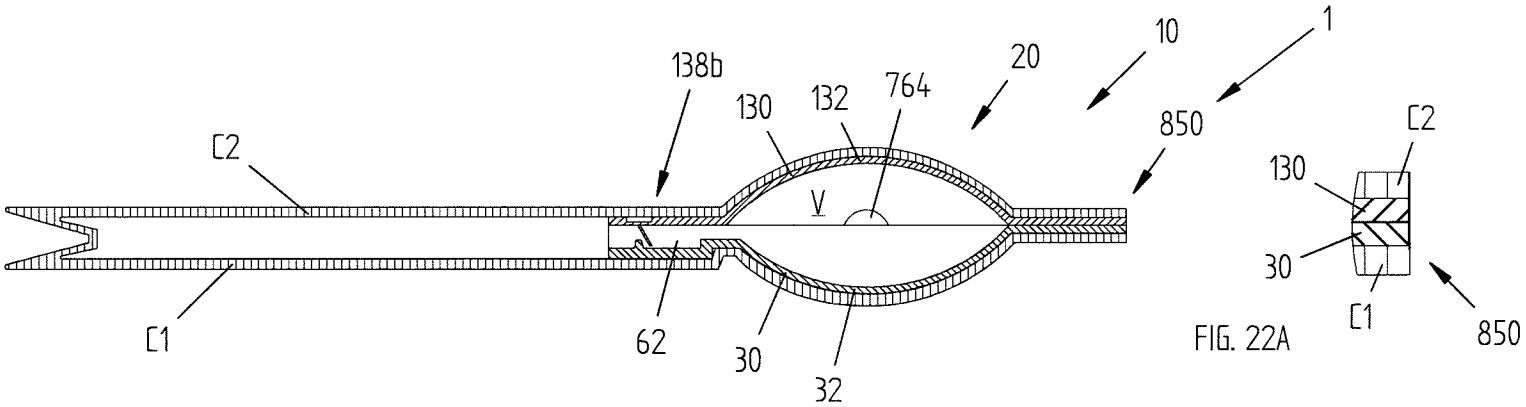
FIG. 22
FIG. 22A

SYSTEM FOR DISPENSING FLUIDS OR MIXTURES AND DEVICE USED IN SAID SYSTEM

This application is a continuation of copending U.S. patent application Ser. No. 16/755,676 filed on Apr. 13, 2020, which is incorporated by reference herein.

TECHNICAL FIELD OF THE INVENTION

The present invention concerns the technical field of systems for dispensing fluids or mixtures.

More specifically, the present invention concerns a device for dispensing a fluid from a container holding the fluid itself, especially suited to dispense food substances, perfumes, creams or detergents in general.

DESCRIPTION OF THE STATE OF THE ART

It is known that dispensing devices are used in the field of systems for dispensing liquid or creamy products, such as food substances, soaps, creams, detergents or perfumes, wherein said dispensing devices are provided with a collapsible chamber and are applied to the container holding said products.

Said devices are substantially constituted by a supporting structure provided with means for coupling the device with the neck of the container, and with a dispensing unit for the fluid held in the container, constituted by a collapsible chamber suited to suck and contain a dose of the fluid taken from the container and to dispense said dose.

The fluid is sucked into the collapsible chamber and dispensed through manual operation by the user, who first directly compresses and then releases the collapsible chamber by acting thereon with one or more fingers. During the compression step, the fluid contained inside the collapsible chamber is dispensed towards the external environment through a suitable outlet duct. During the successive release step, the collapsible chamber automatically returns to the position in which it is not compressed, sucking a dose of fluid from an inlet duct which is preferably provided with a thin tube that draws the fluid from the inside of the container. The dose of fluid drawn into the chamber itself is thus ready for the successive dispensing operation.

For this purpose, the dispensing device is provided with first valve means that allow or prevent the flow of the fluid from the inside of the container towards the chamber, said valve means being typically constituted by a ball that opens/closes the terminal portion of the thin tube introduced in the chamber.

The dispensing device is also provided with second valve means that allow or prevent the flow of the fluid from the inside of the chamber towards the outlet duct, also said valve means being typically constituted by a ball that opens/closes the outlet duct.

The containers used in said dispensing systems are sometimes constituted by collapsible/deformable containers, commonly known as pouches, sachets, packets or bag-in-boxes.

These systems comprising said types of container are generally of the disposable type.

The dispensing devices belonging to the state of the art, however, pose some drawbacks.

A first drawback posed by said dispensing devices is constituted by their construction complexity.

Another drawback posed by said devices is constituted by their considerable production costs and/or times.

A further drawback posed by said devices is represented by their complexity and by the reduced reliability of the area where the dispensing device is connected to the container.

The object of the present invention is to overcome said drawbacks.

More specifically, it is an object of the present invention to provide a solution that makes it possible to simplify the construction of the dispensing system.

It is another object of the present invention to provide a solution that makes it possible to reduce the production times and/or costs of said dispensing systems.

It is another object of the present invention to provide a dispensing system which is more reliable and more efficient than the devices of the known type.

SUMMARY OF THE PRESENT INVENTION

The present invention is based on the general consideration that it is desirable to provide a system for dispensing a fluid from a container, wherein said system is provided with a dispensing device comprising a collapsible chamber that defines a volume suited to receive a quantity of said fluid to be dispensed, and wherein said chamber is at least partially defined by a first portion and a second portion mutually coupled with each other in such a way that together they define said volume, and wherein said first portion comprises an area connected to said container and said second portion comprises an area connected to said container.

According to a first aspect of the present invention, the subject of the same is a system for dispensing a fluid, comprising a container for said fluid and a device for dispensing said fluid, said device comprising:

- a collapsible chamber which defines a volume suited to receive a quantity of said fluid to be dispensed;
- an inlet duct suited to allow the passage of said fluid from the inside of said container towards said volume;
- first valve means suited to control the passage of said fluid into said inlet duct;
- an outlet duct for said fluid, suited to allow the passage of said fluid from said volume towards the outside;
- second valve means suited to control the passage of said fluid into said outlet duct, wherein said chamber is at least partially defined by a first portion and a second portion mutually coupled with each other in such a way that together they define said volume and define said inlet duct and said outlet duct, wherein said first portion comprises an area connected to said container and wherein said second portion comprises an area connected to said container.

The collapsible chamber is preferably defined by at least one elastically yielding area of the first portion and/or of the second portion.

In a preferred embodiment, the first portion and the second portion are identical and mutually coupled with each other.

According to a preferred embodiment, the first portion or the second portion comprises an elastically yielding centre area and an annular peripheral area from which said centre area extends.

In a preferred embodiment, the first portion and the second portion are identical and mutually coupled with each other by arranging said portions in such a way that the annular peripheral area of the first portion faces and is in contact with the annular peripheral area of the second portion, while the elastically yielding centre area of the first portion and the elastically yielding centre area of the second portion are opposite each other with respect to the contact surface defined by said annular peripheral areas in contact with each other, wherein the elastically yielding centre area of the first portion is under said contact surface and the elastically yielding centre area of the second portion is over said contact surface.

Preferably, the annular peripheral area of the first portion comprises a channel that defines part of said inlet duct.

Preferably, the annular peripheral area of the second portion comprises a channel that defines part of said outlet duct.

Preferably, said mutual coupling of said identical first and second portions is obtained by rotating the same by 180°, in such a way that the channel of the first portion comes to be positioned opposite the channel of the second portion and aligned with it along the same direction.

Preferably, the area of the first portion or of the second portion connected to said container corresponds to said annular peripheral area.

In a preferred embodiment, the first portion and the second portion are mutually coupled with each other through a heat sealing process.

According to a further preferred embodiment, the first portion and the second portion are mutually coupled with each other through a fixing and/or gluing process.

Preferably, the first portion and the second portion are coupled with the container through a heat sealing process.

More preferably, the first portion, the second portion and the container are coupled simultaneously through a single heat sealing step.

According to a preferred embodiment, the container comprises a first portion connected to said first portion of the device and a second portion connected to said second portion of the device.

In a preferred embodiment, the container completely envelops said first portion of said device and/or completely envelops said second portion of said device.

According to a preferred embodiment, the inlet duct and the outlet duct are aligned along the same direction.

Preferably, the system furthermore comprises a sealing element suited to close the outlet duct and to be removed before the dispensing system itself is used.

Preferably, the sealing element is constituted by a removable portion of the container.

According to a preferred embodiment, the container comprises a collapsible/deformable material.

According to a second aspect of the present invention, the subject of the same is a device for dispensing a fluid, suited to be applied to a container which holds said fluid, said device comprising:

- a collapsible chamber which defines a volume suited to receive a quantity of said fluid to be dispensed;
- an inlet duct suited to allow the passage of said fluid from the inside of said container towards said volume;
- first valve means suited to control the passage of said fluid into said inlet duct;
- an outlet duct for said fluid suited to allow the passage of said fluid from said volume towards the outside;
- second valve means suited to control the passage of said fluid into said outlet duct, wherein said chamber is at least partially defined by a first portion and a second portion mutually coupled with each other in such a way that together they define said volume and define said inlet duct and said outlet duct, wherein said first portion comprises an area suited to be connected to said container and wherein said second portion comprises an area suited to be connected to said container.

The collapsible chamber is preferably defined by at least one elastically yielding area of the first portion and/or of the second portion.

In a preferred embodiment, the first portion and the second portion are identical and mutually coupled with each other.

According to a preferred embodiment, the first portion or the second portion comprises an elastically yielding centre area and an annular peripheral area from which said centre area extends.

In a preferred embodiment, the first portion and the second portion are identical and mutually coupled with each other by arranging said portions in such a way that the annular peripheral area of the first portion faces and is in contact with the annular peripheral area of the second portion, while the elastically yielding centre area of the first portion and the elastically yielding centre area of the second portion are opposite each other with respect to the contact surface defined by said annular peripheral areas in contact with each other, wherein the elastically yielding centre area of the first portion is under said contact surface and the elastically yielding centre area of the second portion is over said contact surface.

Preferably, the annular peripheral area of the first portion comprises a channel that defines part of said inlet duct.

Preferably, the annular peripheral area of the second portion comprises a channel that defines part of said outlet duct.

Preferably, said mutual coupling of said identical first and second portions is obtained by rotating the same by 180°, in such a way that the channel of the first portion comes to be positioned opposite the channel of the second portion and aligned with it along the same direction.

Preferably, the area of the first portion or of the second portion suited to be connected to said container corresponds to said annular peripheral area.

In a preferred embodiment, the first portion and the second portion are mutually coupled with each other through a heat sealing process.

According to a further preferred embodiment, the first portion and the second portion are mutually coupled with each other through a fixing and/or gluing process.

According to a preferred embodiment, the inlet duct and the outlet duct are aligned along the same direction.

BRIEF DESCRIPTION OF THE DRAWINGS

Further advantages, objects and characteristics, as well as further embodiments of the present invention, are defined in the claims and will be illustrated in the following description, with reference to the enclosed drawings; in the drawings, corresponding or equivalent characteristics and/or components of the present invention are identified by the same reference numbers. More specifically, in the drawings:

FIG. 19 shows a top plan view of the dispensing system according to another embodiment of the invention;

FIG. 20 shows the sectional view of FIG. 19 according to line XX-XX;

FIG. 20A shows an enlarged detail of FIG. 20;

FIG. 21 shows a variant embodiment of FIG. 19;

FIG. 22 shows the sectional view of FIG. 21 according to line XXII-XXII;

FIG. 22A shows an enlarged detail of FIG. 22.

DETAILED DESCRIPTION OF THE PRESENT INVENTION

Figure 1:
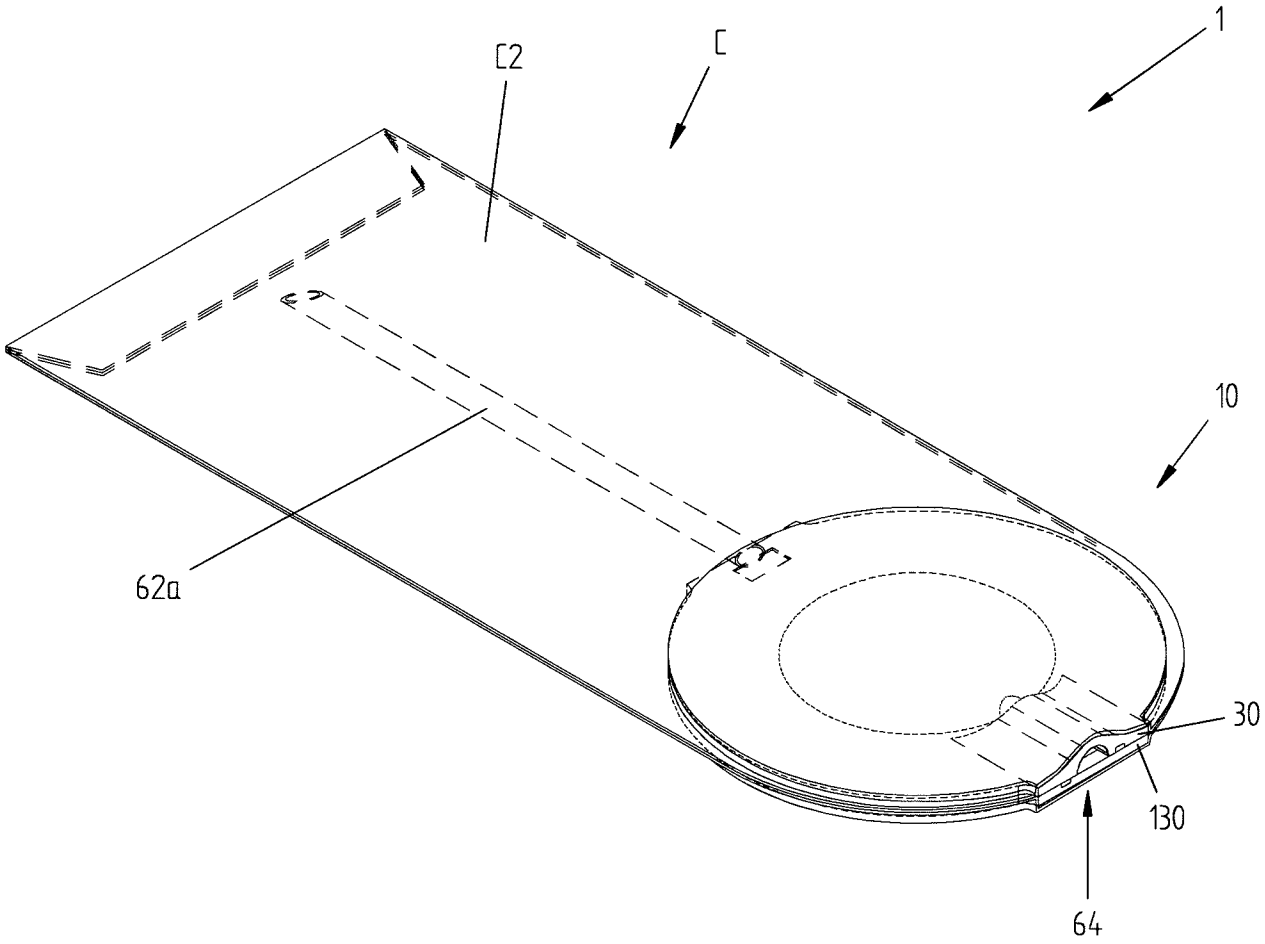
FIG. 1 shows an axonometric view of the dispensing system provided with the corresponding dispensing device according to a preferred embodiment of the invention.

Although the present invention is described below with reference to its embodiments illustrated in the drawings, the present invention is not limited to the embodiments described below and illustrated in the drawings. On the contrary, the embodiments described and illustrated herein clarify some aspects of the present invention, the scope of which is defined in the claims.

The examples of embodiment of the invention described here below concern a dispensing system for dispensing a product preferably constituted by a detergent.

It is clear that the dispensing system of the invention can be used also for dispensing perfumes or food products, or any other fluid in general, withdrawn from a container and conveyed towards the outside.

An example of a dispensing system 1 provided with a dispensing device 10 suited to dispense fluids, both of which are the subjects of the present invention, is shown in FIG. 1. The dispensing system 1 preferably comprises said dispensing device 10 applied to a container C containing the fluid L to be dispensed.

Figure 4:
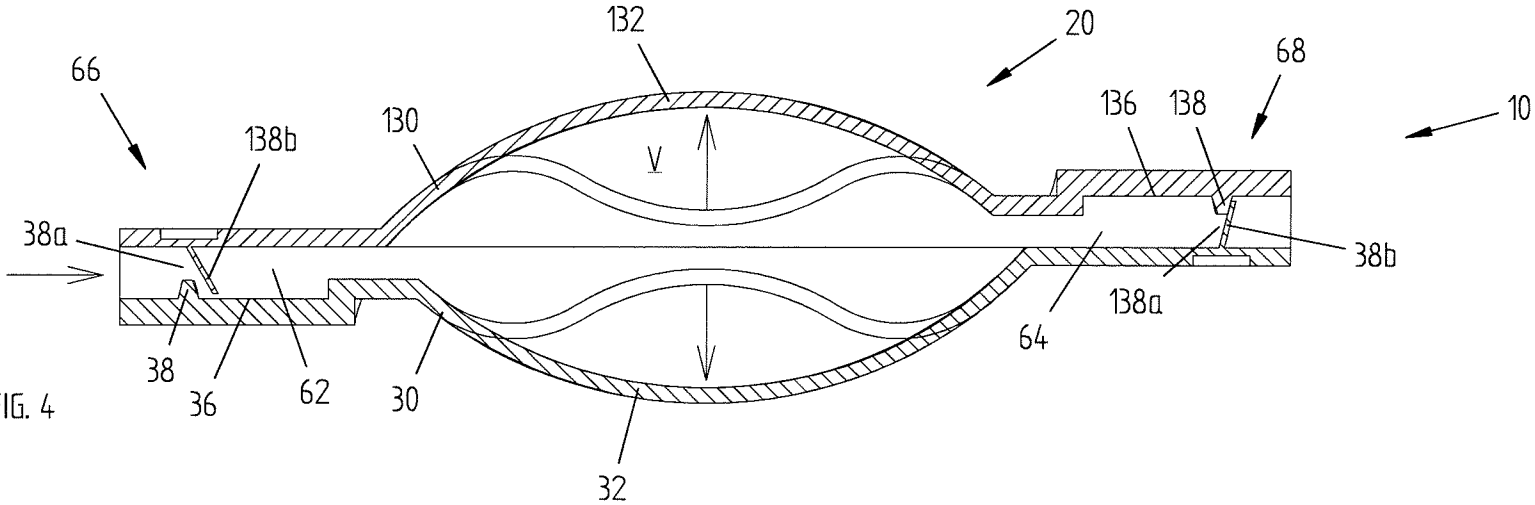
FIG. 4 shows a schematic sectional view of the dispensing device of FIG. 3 isolated from the rest during the passage from a dispensing configuration to a rest configuration.
Figure 5:
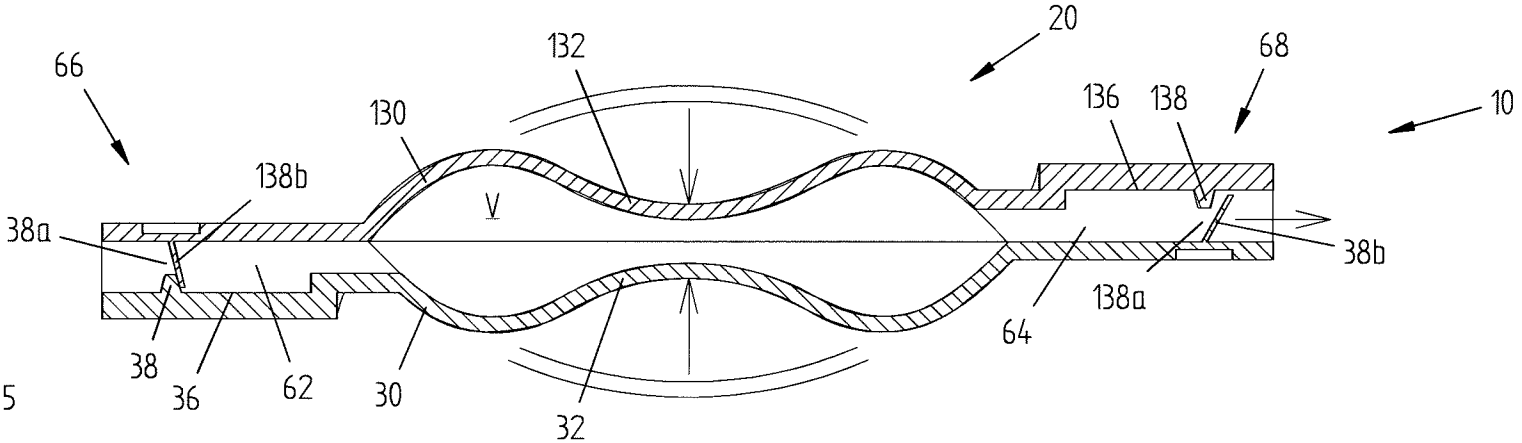
FIG. 5 shows the dispensing device of FIG. 4 during the passage from a rest configuration to a dispensing configuration.

FIGS. 4 and 5 show the dispensing device 10 separate from the container C.

The dispensing device 10 defines the part of the dispensing system 1 which is suited to be operated by the user in order to dispense a dose of a fluid L drawn from the container C.

The fluid L is not represented in the figures for the sake of clarity.

The dispensing device 10 preferably comprises a collapsible chamber 20 which defines a volume V suited to receive a quantity of fluid L to be dispensed.

The collapsible chamber 20, as described in greater detail below, is preferably defined by elastically yielding portions suited to be operated/squeezed by the user.

The dispensing device 10 preferably comprises an inlet duct 62 for the passage of the fluid L from the inside of the container C towards the volume V and an outlet duct 64 for the passage of the fluid L from the volume V towards the outside.

First valve means 66 are associated with the inlet duct 62 in order to control the passage of the fluid L from the container C towards said volume V.

Second valve means 68 are associated with the outlet duct 64 in order to control the passage of the fluid L from said volume V towards the outside.

The volume V defined by the collapsible chamber 20 is suited to contain a dose of the fluid L which is withdrawn from the container C and successively dispensed towards the outside.

The fluid L is sucked into the volume V defined by the collapsible chamber 20 and dispensed through manual operation by the user, who first directly compresses and then releases the collapsible chamber 20 by acting thereon with one or more fingers, as shown in FIGS. 4 and 5. During the compression step shown in FIG. 5, the fluid L contained in the volume V is dispensed towards the outside through the outlet duct 64. During this step, the second valve means 68 are open in order to allow the fluid L to flow towards the outlet, while the first valve means 66 are closed in order to prevent the flow of the fluid L from the volume V towards the inside of the container C.

During the successive release step shown in FIG. 4, the collapsible chamber 20 automatically returns to the position in which it is not compressed, withdrawing a dose of the fluid L from the inside of the container C through the inlet duct 62.

During this step, the first valve means 66 are open in order to allow the fluid L to flow from the inside of the container C towards the volume V, while the second valve means 68 are closed in order to close the outlet duct 64.

The dose of the fluid L sucked into the volume V is thus ready for the successive dispensing operation.

According to a first advantageous aspect of the present invention, the collapsible chamber 20 is defined by a first portion 30, also identified as lower portion in the various figures, and by a second portion 130, also identified as upper portion in the various figures, which are coupled with each other in such a way that together they define said volume V.

In the preferred embodiment, the first portion 30 and the second portion 130 are identical and are conveniently coupled with each other in such a way as to define the dispensing device 10 according to the invention, as is described in greater detail below.

During the coupling step, the first portion 30 and the second portion 130 are oriented opposite each other.

At least one area 32, 132 of said portions 30, 130 is elastically yielding, in such a way that it defines said collapsible chamber 20 and can be deformed when the user squeezes it. Preferably, this is achieved by selecting a suitable material and/or a suitable thickness of the portions and of the respective elastically yielding areas 32, 132. The elastically yielding areas 32, 132 preferably have a hemispherical shape.

Said portions 30, 130 of the device 10 are preferably made of a plastic material, preferably through an injection moulding process.

An advantageous aspect of the present invention related to the fact that the first portion and the second portion are identical lies in the reduction of the time and costs required to make the device, since, more specifically, a single mould is needed to make the portions.

Figure 6:
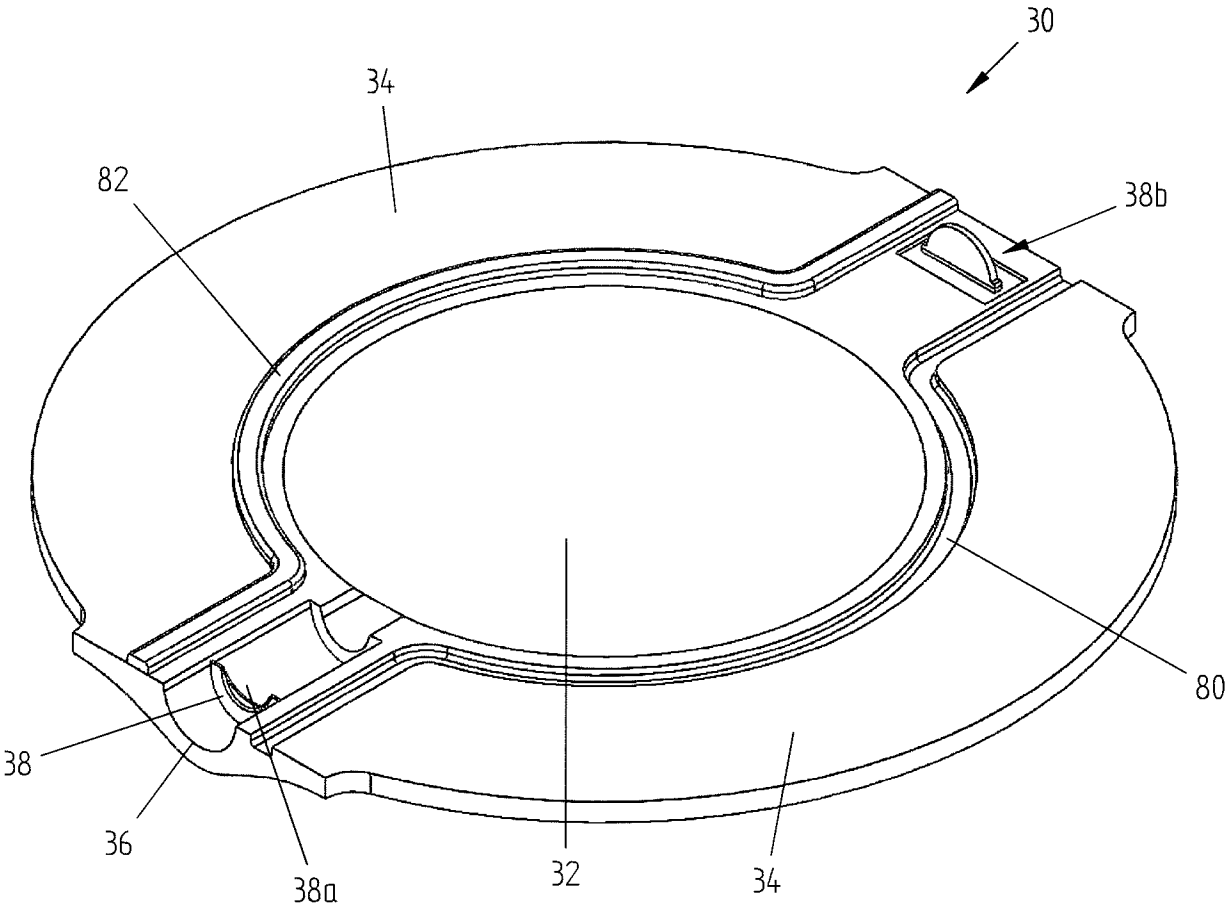
FIG. 6 shows an axonometric view of a part of the dispensing device shown in FIG. 1.

The first portion 30, or second portion 130, is illustrated in greater detail in FIG. 6. For the sake of simplicity, the description below refers only to the first portion 30, it being understood that the details illustrated with regard to the first portion 30 are valid, mutatis mutandis, also for the second portion 130, since they are identical. The reference numbers that identify the elements of the second portion 130 correspond to the reference numbers used for the first portion 30, increased by 100.

The first portion 30 comprises said elastically yielding area 32 that extends centrally towards an annular peripheral area 34 which is preferably substantially flat.

The elastically yielding centre area 32 and the annular peripheral area 34 are preferably circular in shape.

In variant embodiments, however, said shape can be different.

The annular peripheral area 34 comprises, in a specific selected point, a channel 36 that defines part of the inlet duct 62 of the device 10 when the first portion 30 is coupled with the second portion 130. The inlet duct 62 is therefore defined by the channel 36 of the first portion 30 and delimited by the annular peripheral area 134 of the second portion 130.

Analogously, the annular peripheral area 134 of the second portion 130 comprises, in a specific selected point, a channel 136 that defines part of the outlet duct 64 of the device 10 when the first portion 30 is coupled with the second portion 130. The outlet duct 64 is therefore defined by the channel 136 of the second portion 130 and delimited by the annular peripheral area 34 of the first portion 30.

Advantageously, therefore, when the first portion 30 and the second portion 130 are coupled with each other, they define said inlet duct 62 and said outlet duct 64.

Preferably, the mutual coupling of the first portion 30 with the second portion 130 is achieved by arranging the portions 30, 130 in such a way that the annular peripheral area 34 of the first portion 30 faces and is in contact with the annular peripheral area 134 of the second portion 130, while the elastically yielding centre area 32 of the first portion 30 and the elastically yielding centre area 132 of the second portion 130 are opposite each other with respect to the contact surface defined by said annular peripheral areas 34, 134 in contact with each other, wherein the elastically yielding centre area 32 of the first portion 30 is under said contact surface and the elastically yielding centre area 132 of the second portion 130 is over said contact surface.

Furthermore, said mutual coupling of the portions 30, 130 is preferably obtained by rotating the same by 180°, in such a way that the channel 36 of the first portion 30 is opposite the channel 136 of the second portion 130 and aligned with it along the same direction.

Preferably, therefore, the inlet duct 62 and the outlet duct 64 are aligned along the same direction, that is, they preferably lie at 180° from each other.

The channel 36 of the first portion 30 preferably comprises a part of the first valve means 66, constituted by a portion 38 that partially obstructs the channel 36, and a passage opening 38*a*.

The other part of the first valve means 66 consists of a tab 138*b* defined in the second portion 130 that extends from the annular peripheral area 134.

When the first portion 30 and the second portion 130 are coupled with each other, the tab 138*b* of the second portion is conveniently arranged so that it abuts the portion 38 of the channel 36 and is positioned at the level of the passage opening 38*a*.

Analogously, the channel 136 of the second portion 130 preferably comprises a part of the second valve means 68, constituted by a portion 138 that partially obstructs the channel 136, and a passage opening 138*a*.

The other part of the second valve means 68 consists of a tab 38*b* defined in the first portion 30 that extends from the annular peripheral area 34.

When the first portion 30 and the second portion 130 are coupled with each other, the tab 38*b* of the first portion is conveniently arranged so that it abuts the portion 138 of the channel 136 and is positioned at the level of the passage opening 138*a*.

The mutual cooperation of the tabs 38*b*, 138*b* with the respective passage openings 138*a*, 38*a* serves the desired function of an open/closed valve as described above, particularly with reference to FIGS. 4 and 5.

Figure 7:
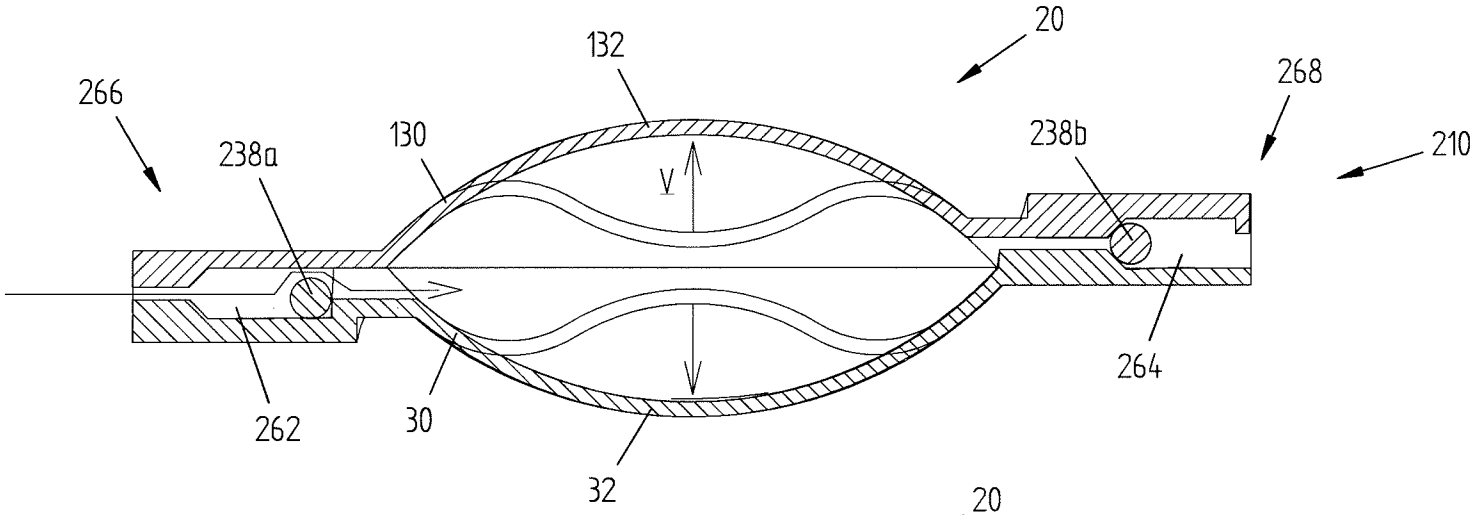
FIG. 7 shows a first variant embodiment of the dispensing device of FIG. 4 during the passage from a dispensing configuration to a rest configuration.
Figure 8:
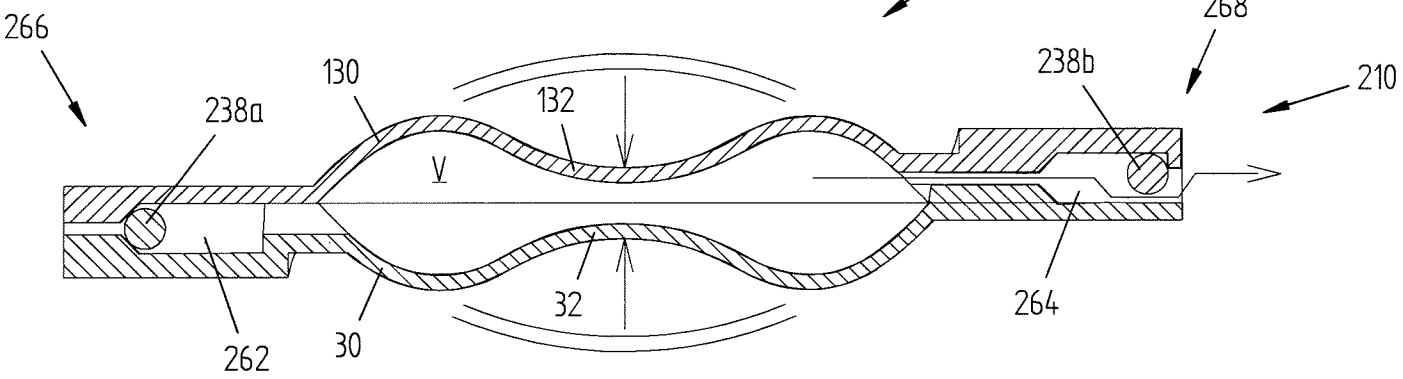
FIG. 8 shows the dispensing device of FIG. 7 during the passage from a rest configuration to a dispensing configuration.
Figure 11:
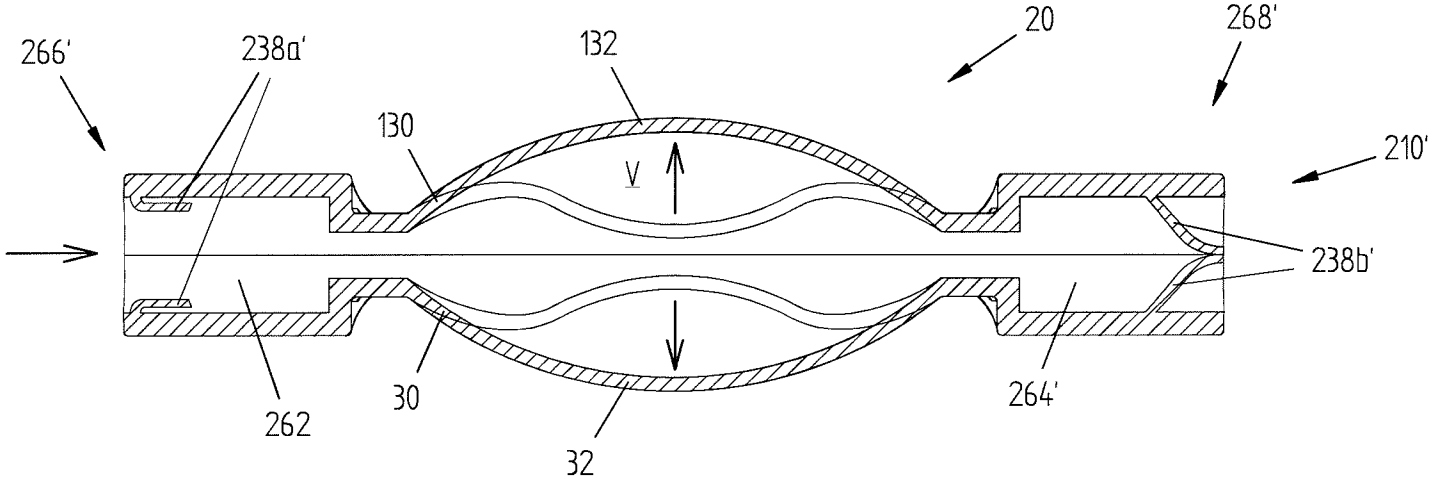
FIG. 11 shows another variant embodiment of the dispensing device of FIG. 4 during the passage from a dispensing configuration to a rest configuration.
Figure 12:
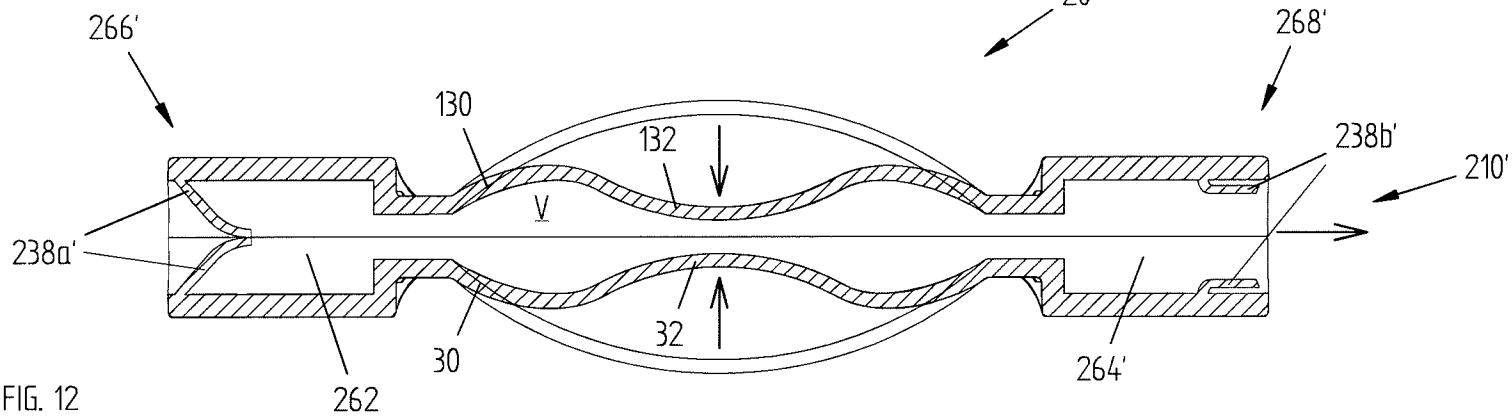
FIG. 12 shows the dispensing device of FIG. 11 during the passage from a rest configuration to a dispensing configuration.

In variant embodiments, the first and/or the second valve means can be of different types, as shown for example in FIGS. 7 and 8, where the function of opening/closing the respective channels is served by balls instead of tabs, or as shown, for example, in FIGS. 11 and 12, where the function to open/close the respective channels is served by several tabs.

Preferably, the first portion 30 comprises also a projecting rib 80 and a recess 82, which are defined on opposite sides of the annular peripheral area 34.

Analogously, the second portion 130 preferably comprises also a projecting rib 180 and a recess 182, which are defined on opposite sides of the annular peripheral area 134.

When the first portion 30 and the second portion 130 are coupled together, the projecting rib 80 of the first portion fits in the recess 182 of the second portion and the recess 82 of the first portion 30 receives the projecting rib 180 of the second portion 130.

This allows the two portions 30, 130 to be correctly positioned with respect to each other. Furthermore, this guarantees better water tightness of the two portions 30, 130.

The mutual coupling of the first and the second portion 30, 130 is preferably obtained by heat sealing the annular peripheral areas 34, 134. In variant embodiments, however, different connection means can be used, such as, for example, fixing means or an adhesive substance.

A further advantageous aspect of the present invention is related to the mutual connection between the dispensing device 10 and the container C.

More specifically, the first portion 30 of the device 10 comprises an area which is directly connected to the container C and the second portion 130 comprises an area which is directly connected to the container C.

Figure 2:
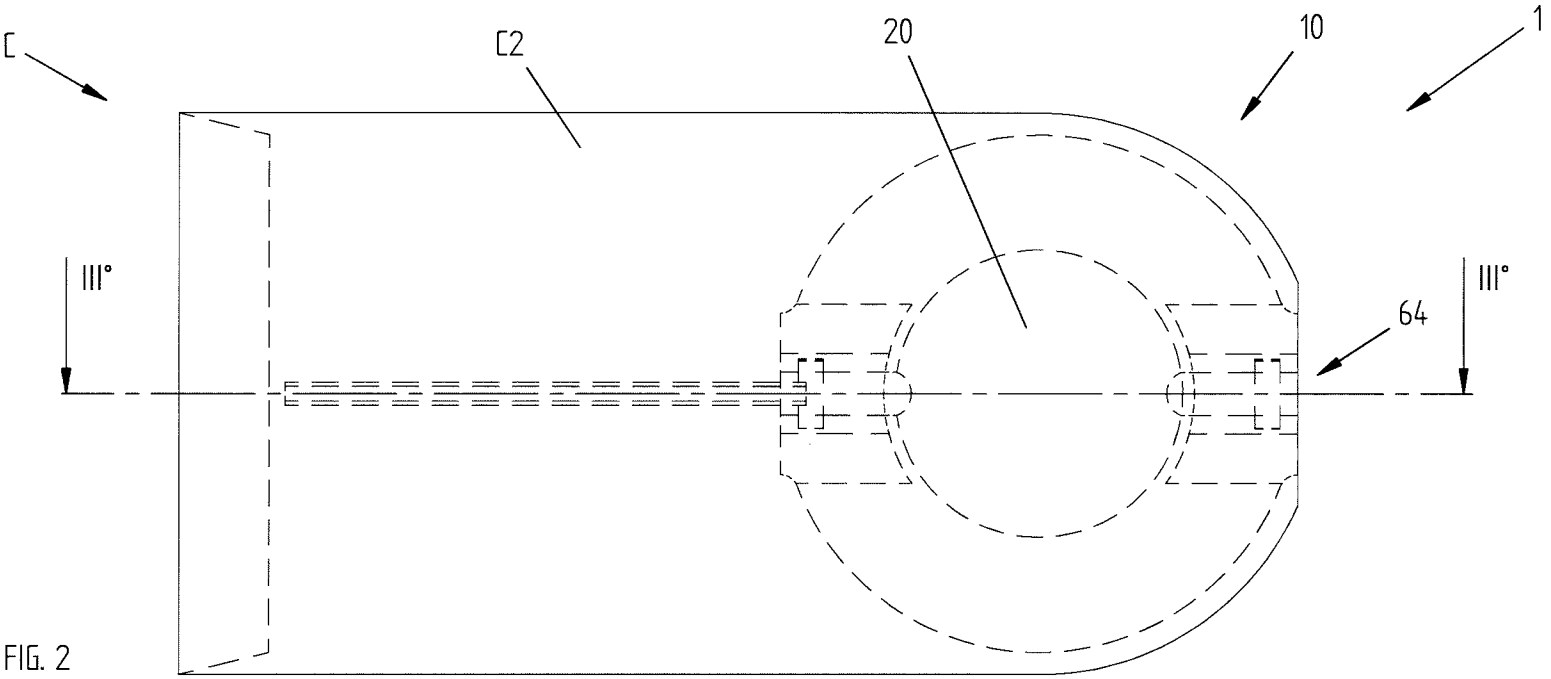
FIG. 2 shows a top plan view of the dispensing system shown in FIG. 1.
Figure 3:
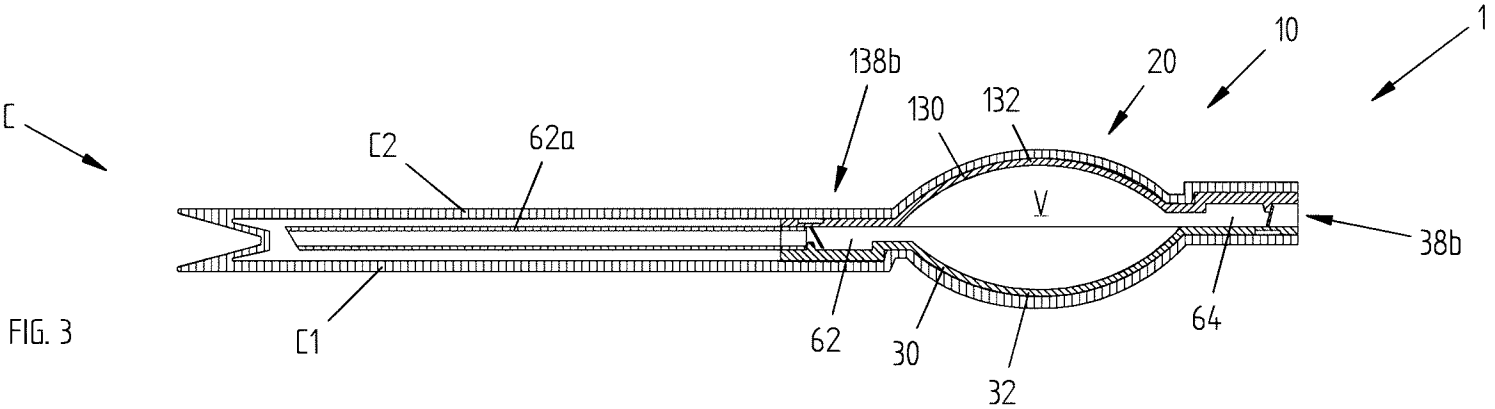
FIG. 3 shows the sectional view of FIG. 2 according to line III-III.

In the preferred embodiment illustrated herein, more specifically as shown in FIGS. 2 and 3, the container C is preferably made of a collapsible/deformable material. This type of container is commonly known as pouche, sachet, packet or bag-in-box.

Preferably, the container C comprises a first portion C1, also identified as lower portion in the various figures, and a second portion C2, also identified as upper portion in the various figures, which are mutually coupled in order to define a convenient volume for containing the fluid L.

Preferably, the lower portion C1 of the container C completely envelops the lower portion 30 of the dispensing device 10 and the upper portion C2 of the container C completely envelops the upper portion 130 of the dispensing device 10.

The deformability of the chamber 20 of the dispensing device 10 is advantageously guaranteed by the collapsible/deformable material of which the portions C1, C2 of the container C are made.

Preferably, the portions C1, C2 of the container C comprise a respective plastic film.

The portions C1, C2 can be preferably made of composite materials or of materials such as PET, PE, PP, EVOH, NYLON, aluminium, etc.

According to an advantageous aspect of the present invention, the coupling of the lower portion C1 and the upper portion C2 of the container C with the corresponding lower portion 30 and upper portion 130 of the dispensing device 10 is preferably obtained through a heat sealing process.

According to a first embodiment, said coupling is carried out in a successive step, after the production of the dispensing device 10.

According to another preferred embodiment, the coupling of the lower portion 30 with the upper portion 130 of the dispensing device 10 and the coupling of the lower portion C1 and upper portion C2 of the container C are advantageously carried out in a single step, by superimposing them and gluing them to each other.

According to a preferred embodiment, the gluing process includes a heat sealing step, preferably at the level of the annular peripheral areas 34, 134 of the two portions 30, 130 of the device 10. In variant embodiments, connection means of a different type can be used, for example an adhesive substance or a connection through mutual fixing.

Advantageously, the construction of the dispensing device 10 and of the dispensing system 1 according to the invention is simplified compared to the systems known in the art.

Advantageously, the respective production times and/or costs of said dispensing systems are reduced compared to the systems known in the art.

The simplified implementation of the dispensing system leads to increased reliability and efficiency compared to the systems of the known type.

Furthermore, the connection of the type described above between the dispensing device 10 and the container C is more reliable than in the systems of the known type, in which the container typically needs a portion made ad hoc, for example a more or less rigid neck, for connection to the dispensing device.

It should be noted that in the embodiment illustrated above the inlet duct 62 is preferably associated with a suction pipe 62*a* whose predetermined length is such that it substantially terminates in proximity to the bottom of the container C, as can be seen in FIG. 3. This favours the suction of the fluid L down to the bottom of the container C.

In variant embodiments, however, said suction pipe may be absent.

FIGS. 7 and 8 show a variant embodiment 210 of the dispensing device of the invention, as already mentioned above, which differs from the previous embodiment due to the shape of the first and second valve means 266, 268, which in this case preferably comprise two balls 238*a*, 238*b* instead of two tabs, intended to serve the function to open/close the respective inlet channel 262 and outlet channel 264.

Figure 9:
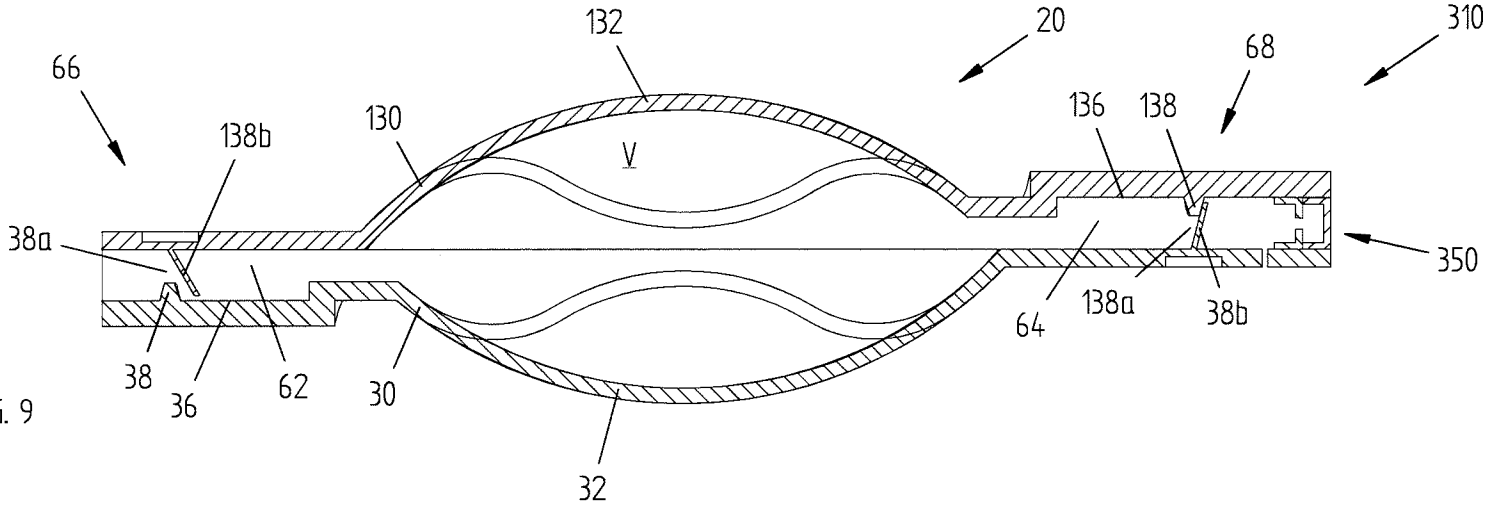
FIG. 9 shows the dispensing device of FIG. 4 according to another variant embodiment.

FIG. 9 shows a variant embodiment 310 of the dispensing device of the invention, which differs from the previous embodiment illustrated in Figures from 1 to 6 due to the fact that it also comprises an element 350 for the formation of foam at the level of the outlet duct 64. Said element 350 preferably comprises a hollow cylindrical element whose external surface is provided with microholes, or with a net, for the generation of foam.

Figure 10:
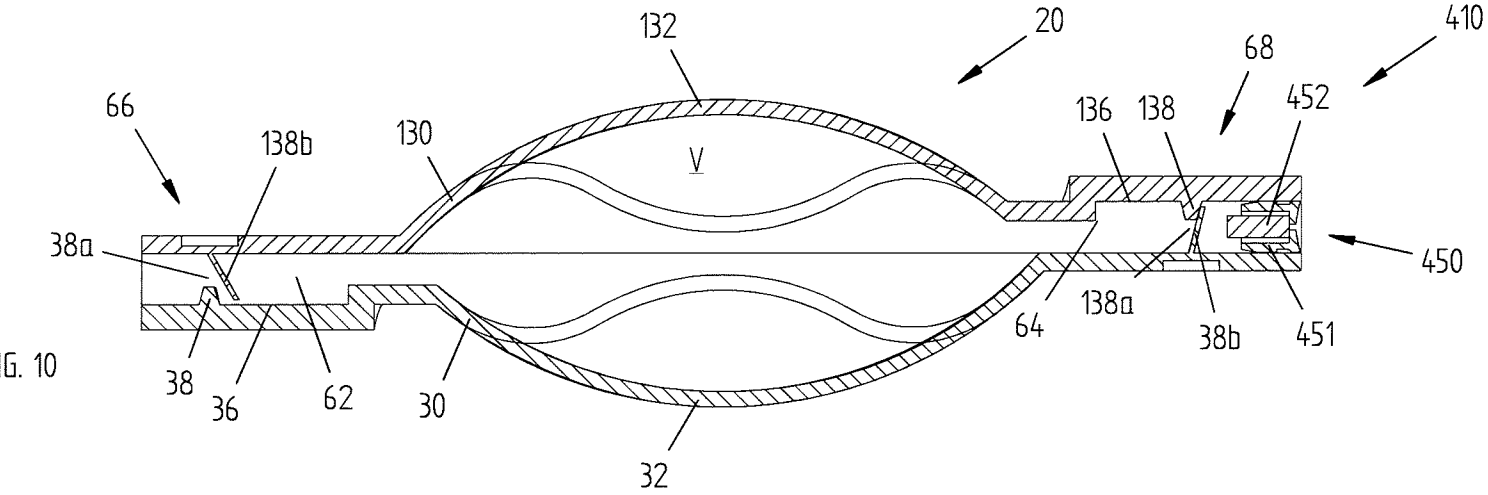
FIG. 10 shows the dispensing device of FIG. 4 according to a further variant embodiment.

FIG. 10 shows a variant embodiment 410 of the dispensing device of the invention, which differs from the previous embodiment illustrated in Figures from 1 to 6 in that it comprises also a device 450 for dispensing the fluid L in the form of spray. Said element 450 preferably comprises a hollow cylindrical element 451, whose final surface is suited to create a whirl, and a shutter element 452 received inside it in order to make the liquid flow in the peripheral area of the hollow cylindrical element 451.

FIGS. 11 and 12 show a variant embodiment 210' of the dispensing device of the invention, as already mentioned above, which differs from the previous embodiment illustrated in Figures from 1 to 6 due to the shape of the first and second valve means 266', 268' which in this case preferably comprise two pairs of tabs 238*a*', 238*b*' intended to serve the function of opening/closing the respective inlet channel 262' and outlet channel 264'.

Figure 13:
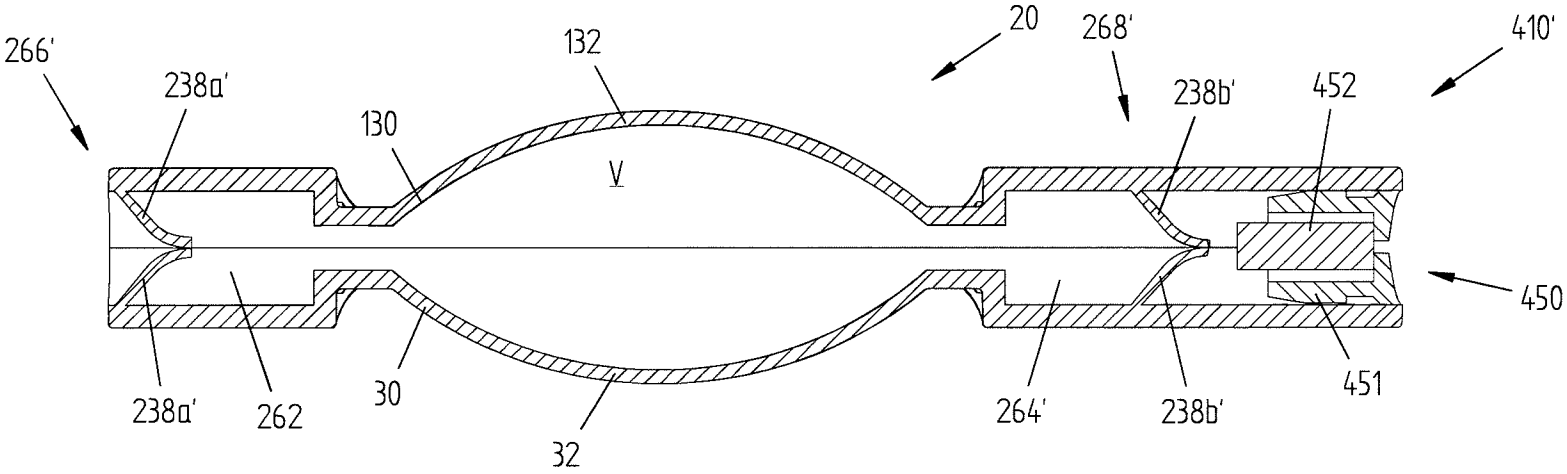
FIG. 13 shows the dispensing device of FIG. 4 according to a further variant embodiment.
Figure 14:
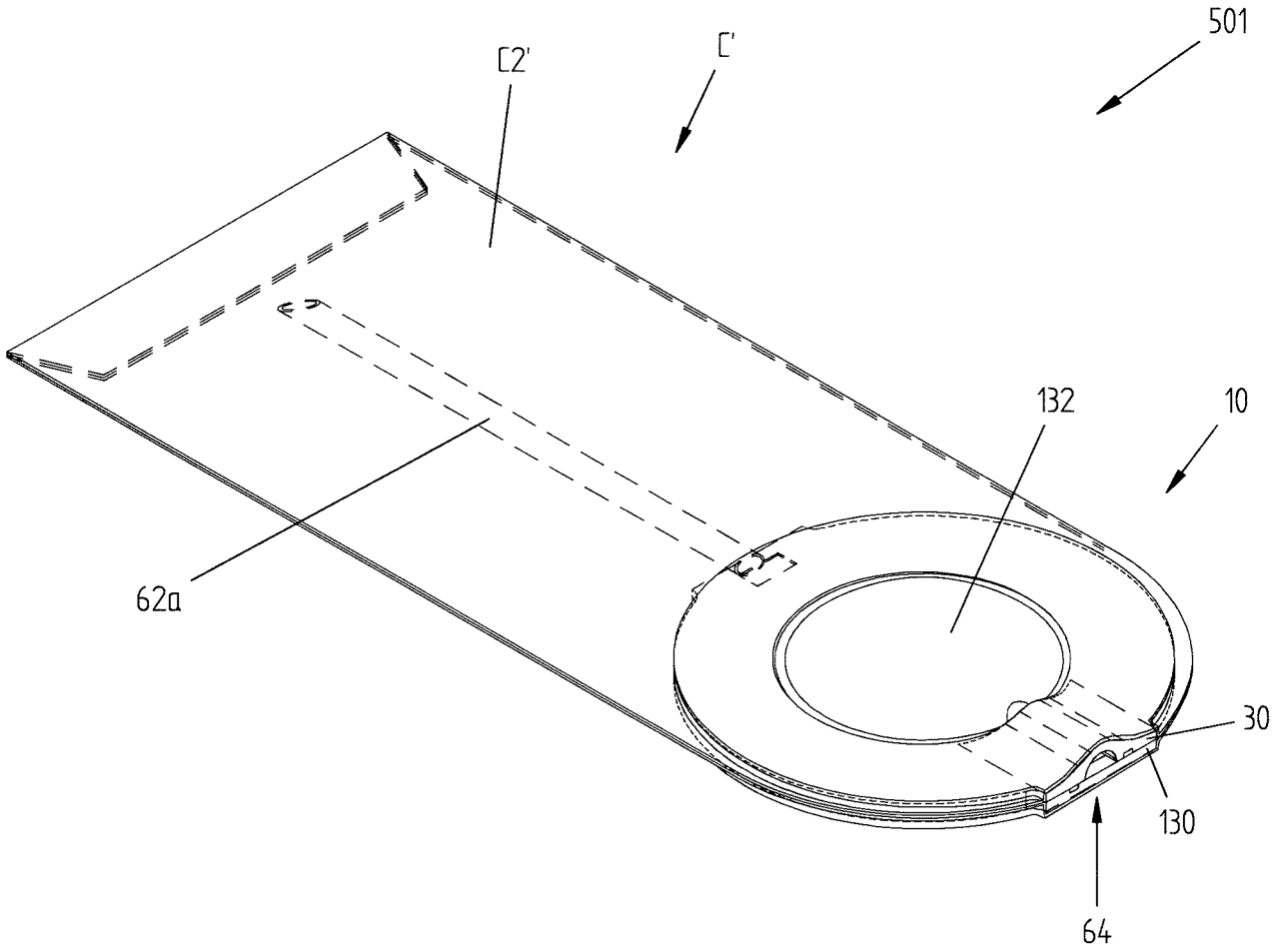
FIG. 14 shows an axonometric view of the dispensing system of FIG. 1 according to another embodiment of the invention.
Figure 15:
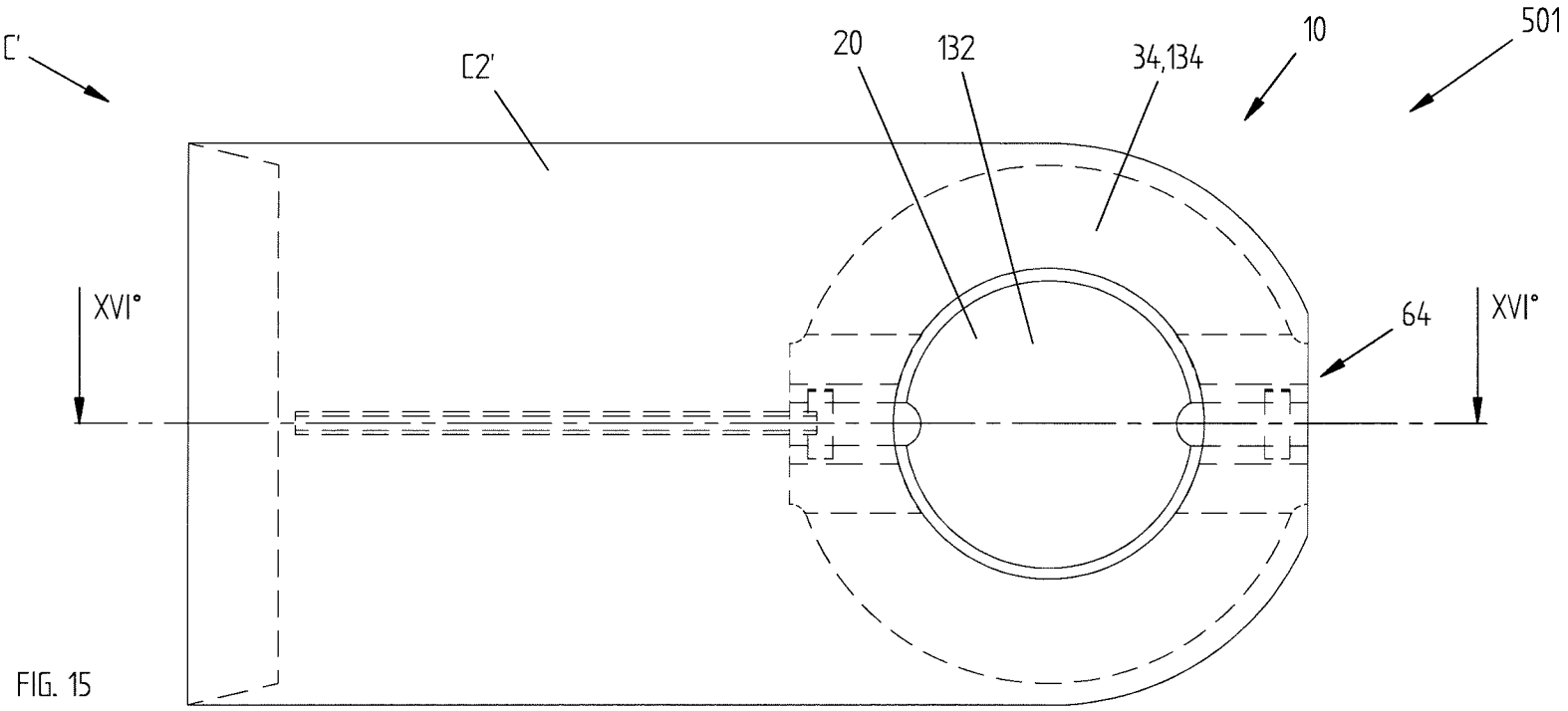
FIG. 15 shows a top plan view of the dispensing system shown in FIG. 14.
Figure 16:
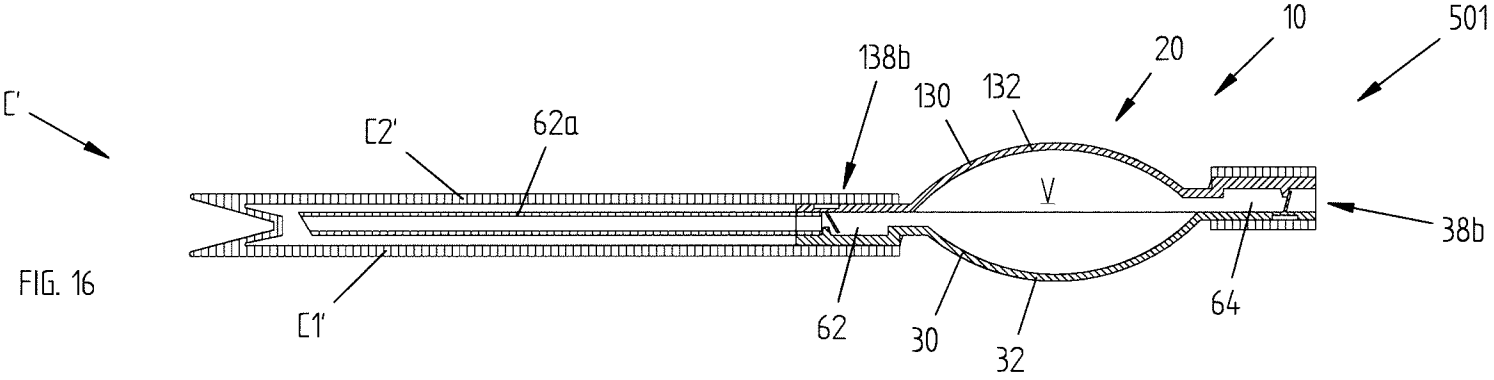
FIG. 16 shows the sectional view of FIG. 15 according to line XVI-XVI.

FIG. 13 shows a variant embodiment 410' of the dispensing device of the invention, which differs from the previous embodiment illustrated in FIGS. 11 and 12 due to the fact that it also comprises a device 450 for dispensing the fluid L in the form of spray. Said element 450 preferably comprises a hollow cylindrical element 451 whose final surface is suited to create a whirl and a shutter element 452 received inside it in order to make the liquid flow in the peripheral area of the hollow cylindrical element 451.

Figures from 14 to 16 show a variant embodiment 501 of the dispensing device of the invention, which differs from the embodiment illustrated with reference to Figures from 1 to 6 due to the fact that the lower portion C1' of the container C' partially envelops the lower portion 30 of the dispensing device 10 and the upper portion C2' of the container C' partially envelops the upper portion 130 of the dispensing device 10. More specifically, the mutual coupling is preferably achieved through a heat sealing process at the level of the annular peripheral areas 34, 134 of the two portions 30, 130 of the dispensing device 10.

The elastic areas 32, 132 of the two portions 30, 130 are therefore advantageously exposed and can be directly accessed by the user.

Said embodiment makes it possible to reduce the material used to make the dispensing system 501, with a consequent reduction in production costs and/or in the weight of the system 501.

Figure 17:
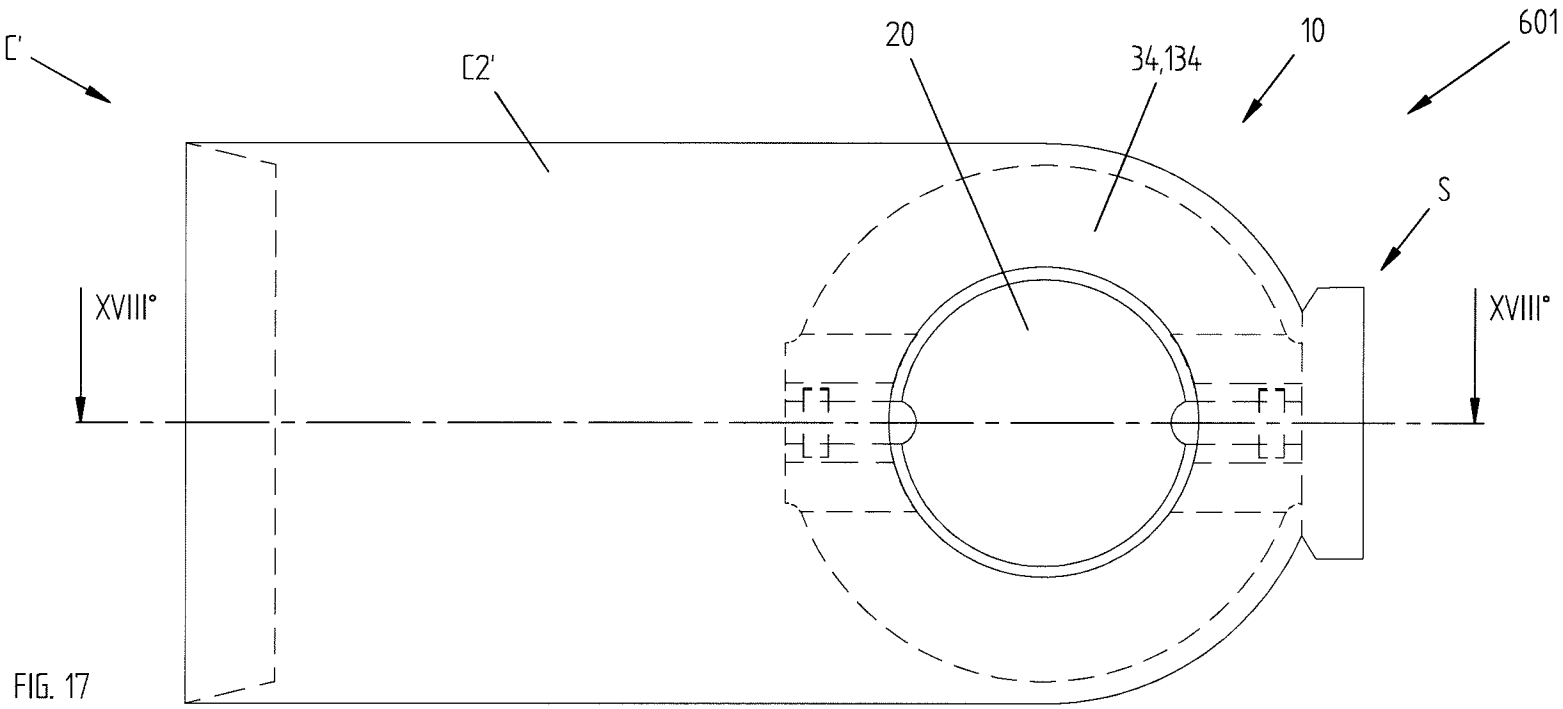
FIG. 17 shows a top plan view of the dispensing system according to another embodiment of the invention.
Figure 18:
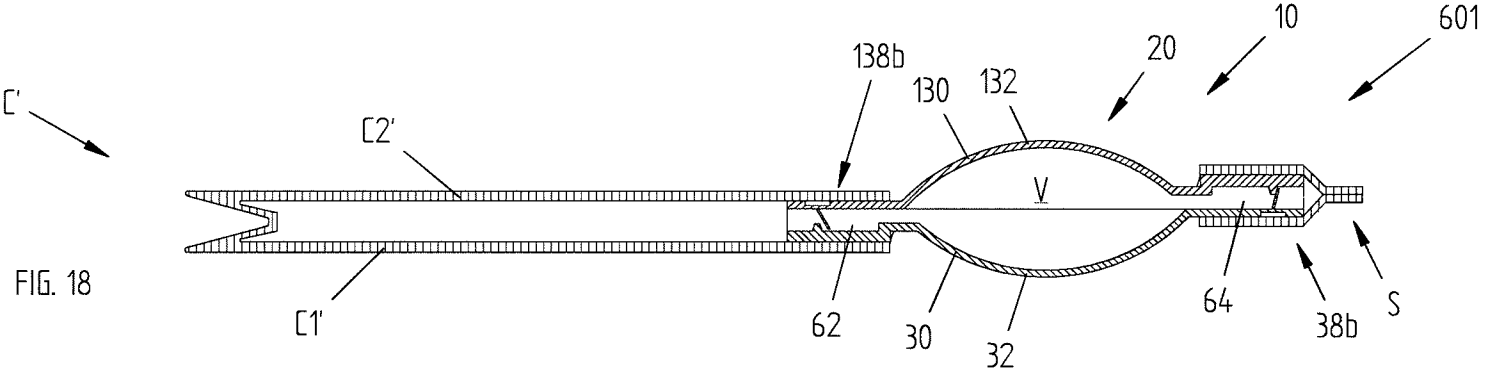
FIG. 18 shows the sectional view of FIG. 17 according to line XVIII-XVIII.

FIGS. 17 and 18 show a variant embodiment 601 of the dispensing device of the invention, which differs from the embodiment 501 of the dispensing system illustrated with reference to Figures from 14 to 16 in that it comprises also a sealing element S associated with the container C1' and arranged at the level of the outlet duct 64 of the dispensing device.

The sealing element S constitutes a removable portion, preferably a tear-off portion, suited to be removed before the dispensing system is used for the first time.

As can be seen in FIG. 18, in this embodiment the suction pipe associated with the inlet duct has been omitted.

FIGS. 19 and 20 show a variant embodiment 701 of the dispensing system of the invention, which differs from the embodiment illustrated with reference to Figures from 1 to 6 due to the fact that the inlet channel 762 and the outlet channel 764 of the dispensing device 710 are not aligned along the same direction, but are arranged according to two different directions, preferably at 90° degrees with respect to each other.

It is evident that in variant embodiments the directions can lie at different angular positions with respect to each other.

From the detail shown in FIG. 20A it can be noticed that the lower portion C1 of the container C extends peripherally beyond the lower portion 30 of the dispensing device 10 and, analogously, the upper portion C2 of the container C extends peripherally beyond the upper portion 130 of the dispensing device 10. This leads to the formation of a peripheral edge 750, which is more visible in FIG. 20A.

Advantageously, the lower portion C1 and the upper portion C2 of the container C are mutually coupled with each other at the level of said edge 750.

This edge guarantees good water tightness of the system.

This characteristic is advantageously present in all of the embodiments illustrated and described above.

In a preferred embodiment, as shown in the dispensing system 801 of FIGS. 21 and 22 and with reference to the detail of FIG. 22A, the lower portion C1 of the container C substantially follows the peripheral outline of the lower portion 30 of the dispensing device 10 and, analogously, the upper portion C2 of the container C substantially follows the peripheral outline of the upper portion 130 of the dispensing device 10, defining a flush edge 850, as shown in FIG. 22A.

This characteristic can obviously be present in all of the embodiments illustrated and described above.

According to the above, it can be understood that the dispensing device that is the subject of the invention has a simplified structure compared to the devices of the known type, with consequently reduced production times and/or costs of the device itself and of the system in general.

The reduced number of elements makes it possible to achieve higher reliability and efficiency compared to the devices of the known type.

The reduced number of elements, furthermore, makes it possible to manufacture a dispensing device with reduced overall dimensions and reduced weight compared to the devices of the known type.

It has thus been shown that the present invention allows the set objects to be achieved. More specifically, it makes it possible to manufacture a device for dispensing fluids whose structure is simplified compared to the devices of the known type.

While the present invention has been described with reference to the specific embodiments shown in the figures, it should be noticed that the present invention is not limited to the specific embodiments illustrated and described herein. For example, the two portions that make up the collapsible chamber are preferably identical. In variant embodiments, however, these portions can be very different from each other. Again, in the embodiments illustrated and described above, both portions of the dispensing device are deformable/collapsible. In variant embodiments, however, only one of the two portions may be collapsible/deformable.

These and other variants of the embodiments described herein fall within the scope of the present invention, which is defined in the claims.

The invention claimed is:

1. A dispensing system integrally formed with a collapsible, pouch- or bag-style container, the system comprising:
- first and second identically-shaped plastic members;
- a container-forming film enveloping the coupled plastic members and sealed along a peripheral edge of the film;
- wherein each plastic member includes an elastically-yielding hemispherical section with a periphery in which a first duct portion is formed spaced apart from a second duct portion and wherein the first duct portion includes a valve formation that is shaped differently in comparison to a valve formation in the second duct;
- wherein the first and second plastic members are oriented so that the first duct of the first member abuts the second duct of the second member, wherein the first and second plastic members are coupled together by a continuous rib and an opposing groove formed around the hemispherical section of each plastic member thereby creating a collapsible chamber defined by the hemispherical sections and inlet and outlet channels defined by the duct portions.

2. The system of claim 1 wherein the container-forming film consists of a composite materials including at least one of PET, PE, PP, EVOH, NYLON, and aluminum.

3. The system of claim 1 wherein the container-forming film includes an upper portion and a lower portion that are heat sealed or adhered together to envelope the plastic members.

4. The system of claim 1 wherein a single ball is captured in each of inlet and outlet channels and wherein each ball is configured to move freely within the inlet and outlet channels so that, on compression of the collapsible chamber, the ball in the inlet channel seals and blocks flow therethrough and, on expansion of the collapsible chamber, the ball in the outlet chamber seals and blocks flow therethrough.

5. The system of claim 1 wherein the valve formation in the first duct comprises a tabs and the valve formation in the second duct comprises second portion that are aligned in abutment to directionally seal the inlet duct or the outlet duct.

6. The system of claim 1 wherein the valve formations include a hollow cylindrical element with a shutter element configure to create a whirl in fluid dispensed by the system.

* * * * *